US005439280A

United States Patent [19]

Steinberg et al.

[11] Patent Number: 5,439,280

[45] Date of Patent: Aug. 8, 1995

[54] FILE HANGER SYSTEM AND CLIPS THEREFOR

[75] Inventors: Richard Steinberg, Bedford; James J. Decknick, Manchester, both of N.H.

[73] Assignee: Keller Products Incorporated, Manchester, N.H.

[21] Appl. No.: 89,689

[22] Filed: Jul. 9, 1993

[51] Int. Cl.[6] ..... B42F 15/00

[52] U.S. Cl. ..... 312/184; 211/64; 402/4

[58] Field of Search ..... 312/184, 193, 348.3, 312/348.5; 211/65; 402/4

[56] References Cited

U.S. PATENT DOCUMENTS

| | | | |
|---|---|---|---|
| 3,456,994 | 7/1969 | Sullivan | 312/184 |
| 3,957,321 | 5/1976 | Rose | 312/184 |
| 4,105,268 | 8/1978 | Elias . | |
| 4,236,770 | 12/1980 | Moore . | |
| 4,708,252 | 11/1987 | Azzi . | |

FOREIGN PATENT DOCUMENTS

| | | | |
|---|---|---|---|
| 629067 | 10/1961 | Canada | 312/184 |
| 1371365 | 7/1964 | France | 312/184 |
| 410728 | 8/1965 | France | 312/184 |
| 261544 | 4/1968 | Germany | 312/184 |
| 422717 | 10/1966 | Switzerland | 312/184 |
| 569278 | 5/1945 | United Kingdom | 312/184 |

*Primary Examiner*—Peter R. Brown
*Assistant Examiner*—David E. Allred
*Attorney, Agent, or Firm*—Davis, Bujold & Streck

[57] ABSTRACT

A file hanger kit, system and clips for mounting file hanging rails in a drawer on a tapered cross-section clip mounting rail running along the top edges of the drawer. The clips are formed in an upside down J configuration having a vertical portion and a generally C-shaped hook portion integral with the top of the vertical portion. The C-shaped hook portion defines and partially encloses a reentrant opening that faces down along the side of the vertical portion for hooking and wedging onto the tapered mounting rail when a downward force is applied to the clip by the files hanging on the rails mounted in the clips.

16 Claims, 1 Drawing Sheet

FILE HANGER SYSTEM AND CLIPS THEREFOR

FIELD OF THE INVENTION

The present invention relates to file hanger systems and associated clips for mounting file hanging rails in a drawer, a system in which in particular, clips are designed to be wedged onto tapered rails mounted on the top edges of a drawer.

BACKGROUND OF THE INVENTION

In the prior art, generally U-shaped clips have been used to mount file hanging rails between the sides of drawers. In the prior clips a downward facing slot, that forms the U-shape, loosely slides over clip support rails mounted on the top edges of the sides of a drawer. The ends of file hanging rails are received in a vertical groove in the sides of the clips facing inward toward one another.

As the prior art clips loosely fit over the rails mounted on the edge of the drawer, the clips freely slide back and forth along the clip support rails the file hanging rails are easily knocked out of position.

The present invention provides clips that wedge onto tapered portion of a clip support rails mounted on the top edges of a drawer when a downward force is applied to the clip. When files are hung on hanging rails mounted between the clips, the weight of the files apply a downward force onto the clips to wedge the clips into place on the tapered mounting rails of the drawer thereby resisting the sliding of the clips out of position.

SUMMARY OF THE INVENTION

According to the invention there is provided a clip for mounting a file hanging rail between two parallel walls having top edges comprising a generally hook shaped clip having; a substantially vertical portion having a top, a bottom, and front and back faces; a generally C-shaped hook portion integral with the top of said vertical portion defining a downward facing opening facing along the back face of said vertical portion for hooking onto a top edge of said walls; a substantially vertical groove in the front face of said vertical portion extending at least partially through said vertical portion, said groove being closed at a lower end thereof to form a shoulder for supporting such a file hanging rail; said downward facing opening in said C-shaped hook portion being reentrant to wedge onto a support rail on said top edge upon application of a hanging weight on the file hanging rail.

Also according to the invention there is provided a kit for hanging files in a drawer comprising elongate clip support rails for clipping onto top edges of walls of a drawer, running along the top edge of said walls; file hanging rails for hanging files thereon; generally hook shaped mounting clips for hooking onto said support rails, and for receiving respective ends of said hanging rails for mounting said hanging rails between the sides of said drawer; said generally hook shaped clips each having a substantially vertical portion having a top, a bottom, and front and back faces; a generally C-shaped hook portion integral with the top of said vertical portion defining a downward facing opening facing along the back face of said vertical portion for hooking onto a top edge of said walls; a substantially vertical groove in the front face of said vertical portion extending at least partially through said vertical portion, said groove being closed at a lower end thereof to form a shoulder for supporting such a file hanging rail; said downward facing opening in said C-shaped hook portion being reentrant to wedge onto a support rail on said top edge upon application of a hanging weight on the file hanging rail.

Also according to the invention there is provided an assembly for hanging files in a drawer comprising file hanging rails; elongate clip support rails, having a tapered cross-section portion, mounted on top edges of a drawer; and generally hook shaped clips hanging from said support rails, ends of said file hanging rails being mounted in respective clips on said clip support rails; said generally hook shaped clips each having a substantially vertical portion having a top, a bottom, and front and back faces; a generally C-shaped hook portion integral with the top of said vertical portion defining a downward facing opening facing along the back face of said vertical portion for hooking onto a top edge of said walls; a substantially vertical groove in the front face of said vertical portion extending at least partially through said vertical portion, said groove being closed at a lower end thereof to form a shoulder for supporting such a file hanging rail; said downward facing opening in said C-shaped hook portion being reentrant to wedge onto a support rail on said top edge upon application of a hanging weight on the file hanging rail; said clips being wedged onto said clip support rails by weight supported on file support rails mounted in and supported by said grooves.

BRIEF DESCRIPTION OF THE DRAWINGS

The invention will now be described, by way of example, with reference to the accompanying drawings in which.

DETAILED DESCRIPTION OF THE INVENTION

Figure 1:
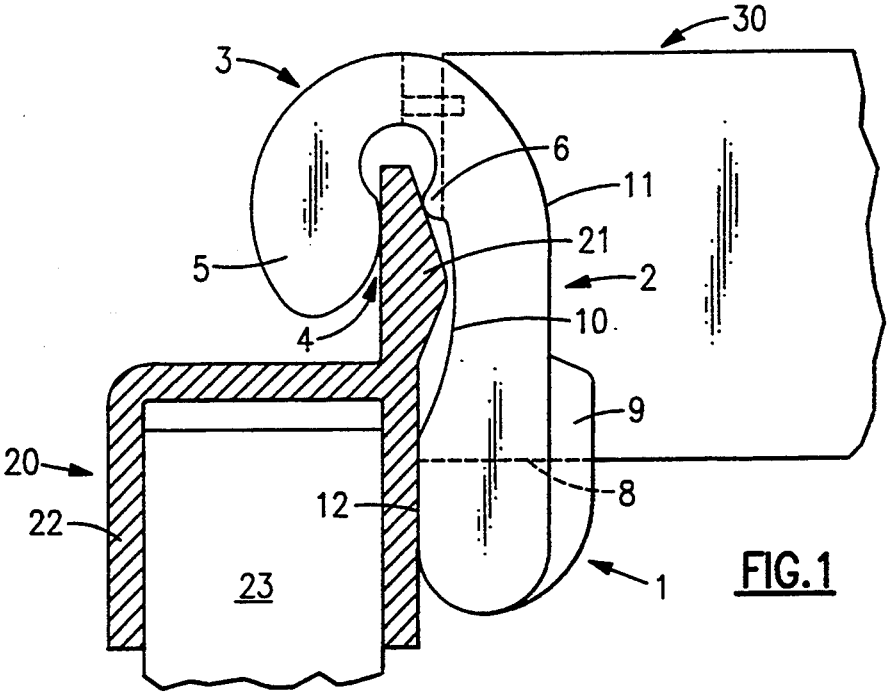
FIG. 1 is a side view of a clip according to the invention in combination with a mounting rail having a tapered cross-section.

In FIG. 1 a file hanger system comprises a clip 1 clip mounting rail 20 and a file hanging rail 30. The clip 1 is formed in a "J" configuration having a vertical portion 2 and C-shaped hook portion 3. The hook portion C is integrally formed on the top of the vertical portion 2 such that opening 4 in the C-shaped hook portion 3 forms a downward facing channel for receiving the top edge of a tapered section of a mounting rail 21 therein.

The end 5 of the C-shaped hook portion partially encloses the opening 4 such that the opening 4 wedges onto the tapered mounting rail 21 frictionally holding the clip 1 in place on the mounting rail 21. A horizontal rounded ridge 6 on the vertical portion 2 likewise partially encloses the opening 4 in the C-shaped portion thereby enhancing the wedging action of the C-shaped portion 3. The width and depth of the opening 4 are chosen in conjunction with the shape and dimensions of the rail 20 to ensure that the wedging action is not interfered with by contact between the rail 20 and the innermost end surface of the opening 4.

Figure 2:
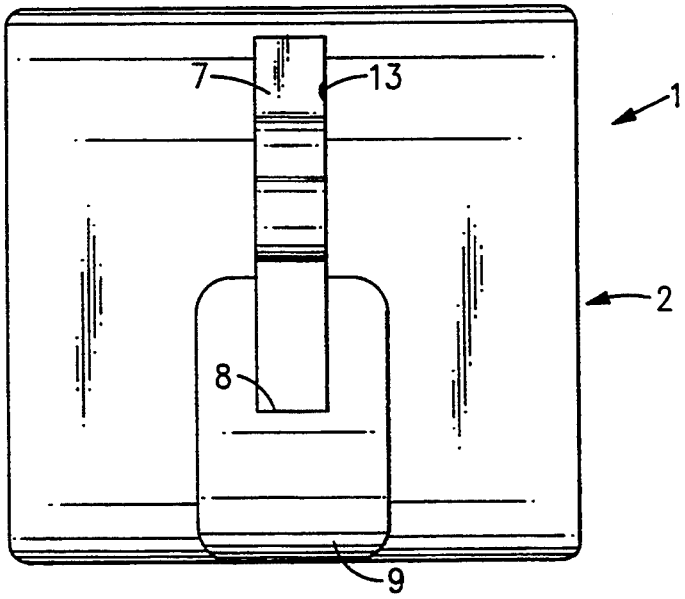
FIG. 2 is a front view of the clip in FIG. 1.
Figure 3:
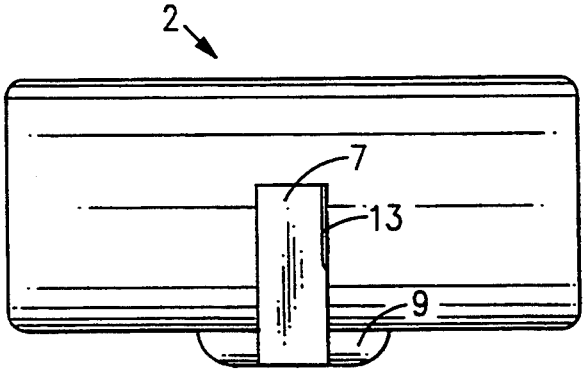
FIG. 3 is a top view of the clip in FIG. 1.

An open topped groove 7, best seen in FIGS. 2 and 3 and shown in ghost in FIG. 1, is formed in the front face 11 of the vertical portion 2. The groove 7 is closed at its lower end by a shoulder 8 and is shaped and dimensioned to receive the file hanging rail 30 therein. The file hanging rail extends into the groove 7 and is supported by the shoulder 8. The shoulder 8 is located somewhat below, in use, the engagement of the opening 4 with a clip mounting rail.

A resilient protuberance 13 is located on a side wall of the groove 7 and extends into the groove to press against and steady file hanging rails of varying thicknesses when received in the groove 7. In this way, thinner file hanging rails are held steadily in the groove and do not wobble while thicker rails can be accommodated.

A portion 9 of the front face of the vertical portion 2 of the clip around the lower end of the groove 8 is extended, reinforcing the clip in the area around the lower end of the groove and enlarging the shoulder 8 for supporting the end of the file hanging rail.

Clips according to the invention are engaged with the tapered rail portion 21 of the clip supporting rail 20, one on each side or end of the drawer, and the ends of file hanging rails are slid into respective grooves 7 of the clips. The weight of files supported on the rails presses down on the shoulders of the clips 1. Thus the clips 1 are pressed downward on the tapered rail 21 and are biased with a turning motion (produced by the leverage of support 8 about the points of engagement with clip support rail 20) such that the openings 4 are wedged onto the tapered rails and the clips are frictionally held in place due to the wedging action of the openings 4 in the C-shaped hook portions 3. In this way, when files are hung upon rails mounted by clips 1, the file hanging rails are frictionally held in place by the wedging action of the clips 1, thereby resisting sliding along the clip support rails so that the file hanging rails are maintained in alignment and proper spacing.

A recess 10 is formed in the rear face 12 of the vertical portion 2 of the clip 1 adjacent the C-shaped clip portion 3 just below the rounded ridge 6. With this configuration, the clip 1 is free to pivot about the tapered rail 21, to the position shown in FIG. 1, further enhancing the wedging action of the hook portion 3. It should be noted that curved contacts 5 and 6 are positioned relative to one another so that the rear face 12 is spaced when the clip is placed on the tapered section of the clip support rail without a load and that pivoting wedging action forces the clip into the position shown in FIG. 1 as sufficient load is applied by the file hanging rail 30.

If it is desired to rearrange the rails, the rails and the clips 1 are easily slid along the tapered rails 21 by relieving the downward force on the clips 1, thereby releasing the wedging action of the clips 1, and sliding the file hanging rail and the clips along the tapered rail 21 to the new desired location.

The entire clip 1 is preferably molded out of plastic as a single integral unit. The clip support rail 20 is preferably extruded as a single integral piece of plastic. It will be appreciated that the clip support rail may be made out of a plastic having sufficient resiliency to clip onto the top edge of the sides or ends of a drawer with sufficient rigidity that the tapered portion 21 steadily and securely supports files on file hanging rails supported by means of the mounting clips 1 according to the invention. As the clip support rails 20 are made out of plastic they can be easily cut to the proper size to fit any drawer.

It can also be appreciated that the clips according to the invention 1 can be sold in combination, or in kit form, with clip support rails 20 and file hanging rails 30.

We claim:

1. A clip for mounting a file hanging rail between two parallel walls having top edges comprising:

a generally hook shaped clip having;

a substantially vertical portion having a top, a bottom, and front and back faces;

a generally C-shaped hook portion integral with the top of said vertical portion defining a downward facing reentrant opening facing along the back face of said vertical portion for hooking onto a top edge of said walls and providing a wedging means;

an aperture defined by the front face of said vertical portion, said aperture providing support for a said file hanging rail; wherein said wedging means comprising a horizontal ridge which extends from said back face adjacent said hook portion to partially define said reentrant opening for abutting opposing sides of a said top edge, whereby, when a hanging weight is applied to a said file hanging rail supported in said aperture, said reentrant opening wedges onto a said top edge when hooked thereon.

2. A clip according to claim 1, further comprising:

a protuberance extending into said aperture to engage and support a rail in said aperture.

3. A clip according to claim 1, further comprising:

a protruding portion on the front face of said vertical portion around the lower side of said aperture to improve said support.

4. A clip according to claim 1, further comprising:

a horizontally extending recess in the back face of said vertical portion, a top side of said recess partially defining said horizontal ridge in the form of a horizontal rounded ridge.

5. A clip according to claim 1 wherein the reentrant opening is shaped to increase the wedging engagement of the clip onto the associated top edge by a pivoting moment of the clip about the support rail upon application of said hanging weight to a file hanging rail engaged in said groove.

6. A kit for hanging files in a drawer comprising:

elongate clip support rails for clipping onto top edges of opposed walls of a drawer and running along the top edges of said walls;

file hanging rails for hanging files thereon;

generally hook shaped mounting clips for hooking onto said support rails in opposed pairs, and for receiving respective ends of said hanging rails for mounting said hanging rails between opposed walls of said drawer;

said generally hook shaped clips each having:

a substantially vertical portion having a top, a bottom, and front and back faces;

a generally C-shaped hook portion integral with the top of said vertical portion defining a downward facing reentrant opening facing along the back face of said vertical portion for hooking onto a top edge of said support rails and providing a wedging means;

an aperture defined by the front face of said vertical portion, said aperture providing support for a said file hanging rail; wherein said wedging means comprising a horizontally extending ridge which extends from said back face adjacent said hook portion to partially define said reentrant opening for abutting opposing sides of a said top edge, whereby, when a hanging weight is applied to said file hanging rail supported in said aperture and said clip is hooked onto said support rail, said opening wedges onto that support rail on a said top edge.

7. A kit according to claim 6, said elongate clip support rails comprising:

an elongate generally U-shaped portion having resilient downward extending sides for clipping onto the top edge of said drawer; and a rail portion extending upwards from said U-shaped portion, said rail portion having a cross-section that tapers from a relatively wide section adjacent the U-shaped portion to a relatively thin section at a top of said rail portion.

8. A kit according to claim 6, each mounting clip further comprising:

a protuberance extending into said aperture to engage and support a file hanging rail steady in said aperture.

9. A kit according to claim 8, each mounting clip further comprising:

a protruding portion on said front face of said clip around the lower side of said aperture to improve said support.

10. A kit according to claim 6, each mounting clip further comprising:

an horizontally extending recess in the back face of said vertical portion, a top side of said recess partially defining said horizontal ridge in the form of a horizontal rounded ridge, on said back face adjacent and immediately above said recess, partially enclosing said opening.

11. A kit according to claim 6 wherein the reentrant opening is shaped to increase the wedging engagement of the clip onto the top edge of said support rails by a pivoting moment of the clip about the support rail upon application of said hanging weight to a file hanging rail engaged in said groove.

12. An assembly for hanging files in a drawer comprising:

file hanging rails;

elongate clip support rails, having a tapered cross-section portion, mounted on opposed top edges of a drawer; and opposed pairs of generally hook shaped clips hanging from said support rails, ends of said file hanging rails being mounted in respective pairs of clips on said clip support rails;

said generally hook shaped clips each having:

a substantially vertical portion having a top, a bottom, and front and back faces;

a generally C-shaped hook portion integral with the top of said vertical portion defining a downward facing reentrant opening facing along the back face of said vertical portion for hooking onto a top edge of said tapered portions of said support rails and providing a wedging means;

an aperture defined by the front face of said vertical portion, said aperture providing support for a said file hanging rail; wherein said wedging means comprising a horizontally extending ridge which extends from said back face adjacent said hook portion to partially define said reentrant opening for abutting opposing sides of each of said top edges, whereby, when a hanging weight is applied to said file hanging rail supported in said aperture, said opening wedges onto that support rail on a said top edge.

13. An assembly according to claim 12, said elongate support rails comprising:

an elongate generally U-shaped portion having resilient downward extending sides for clipping onto the top edge of said drawer;

a rail portion extending upwards from said U-shaped portion, said rail portion having a cross-section that tapers from a relatively wide section adjacent the U-shaped portion to a relatively thin section at a top of said rail portion.

14. An assembly according to claim 12, said clip further comprising:

a protuberance on at least one side of said groove in said front face for steadily holding a hanging rail in said groove;

a built up portion on said front face of said clip around the lower end of said groove.

15. An assembly according to claim 12, further comprising:

an horizontally extending recess in the back face of said vertical portion, wherein a top side of said recess partially defines said horizontal ridge in the form of a horizontal rounded ridge, on said back face adjacent and immediately above said recess, partially enclosing said opening.

16. An assembly according to claim 12 wherein the reentrant opening is shaped to increase the wedging engagement of the clip onto the top edge of said support by a pivoting moment of the clip about the support rail upon application of said hanging weight to a file hanging rail engaged in said groove.

* * * * *

UNITED STATES PATENT AND TRADEMARK OFFICE

CERTIFICATE OF CORRECTION

PATENT NO. : 5,439,280

DATED : August 8, 1995

INVENTOR(S) : Richard Steinberg, et al

It is certified that error appears in the above-indentified patent and that said Letters Patent is hereby corrected as shown below:

Column 4, line 15 - change "horizontal ridge" to "protrusion";

Column 4, line 30 - change "1" to "17";

Column 4, lines 63 and 64 - change "horizontally extending ridge" to "protrusion"

Column 5, line 24 - change "6" to "18"

Column 5, line 46 - change "respective pairs" to "respective said pairs"

Column 6, lines 10 and 11 - change "horizontally extending ridge" to "protrusion"

Column 6, line 35 - change "12" to "19"

UNITED STATES PATENT AND TRADEMARK OFFICE

CERTIFICATE OF CORRECTION

PATENT NO. : 5,439,280

DATED : August 8, 1995

INVENTOR(S) : Richard Steinberg, et al

It is certified that error appears in the above-indentified patent and that said Letters Patent is hereby corrected as shown below:

Col. 6, line 50 add "17. A clip according to claim 1 wherein said protrusion comprises a horizontally extending ridge.
18. A kit according to claim 6 wherein said protrusion comprises a horizontally extending ridge.
19. An assembly according to claim 12 wherein said protrusion comprises a horizontally extending ridge.

Signed and Sealed this

Fifth Day of December, 1995

Bruce Lehman

*Attest:*

BRUCE LEHMAN

*Attesting Officer*

*Commissioner of Patents and Trademarks*